US006660947B1

(12) United States Patent
Badescu

(10) Patent No.: US 6,660,947 B1
(45) Date of Patent: Dec. 9, 2003

(54) METHOD AND APPARATUS FOR PUSH-BUTTON CONTROL

(75) Inventor: Mircea Badescu, North Plainfield, NJ (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/305,409

(22) Filed: Nov. 26, 2002

(51) Int. Cl.[7] ..... H01H 9/00
(52) U.S. Cl. ..... 200/4
(58) Field of Search ..... 200/4, 5 R, 11 R, 200/16 R, 17 R, 18, 336, 341

(56) References Cited

U.S. PATENT DOCUMENTS 4,131,033 A * 12/1978 Wright et al. ..... 74/553
5,581,058 A * 12/1996 Javery et al. ..... 200/4
5,821,480 A * 10/1998 Machida ..... 200/4
5,877,463 A * 3/1999 Choi ..... 200/4
6,154,201 A 11/2000 Levin et al. ..... 345/184
6,423,912 B1 * 7/2002 Arenz et al. ..... 200/43.08

FOREIGN PATENT DOCUMENTS

WO WO 99/49443 3/1999

OTHER PUBLICATIONS

Brochure entitled: "VDO Driving with Fingertip Sensitivity—Programmable Rotating Actuator with Haptic Feedback." Jul. 1999.

* cited by examiner

*Primary Examiner*—Michael Friedhofer
(74) *Attorney, Agent, or Firm*—Kathryn A. Marra

(57) ABSTRACT

A push-button control knob having rotational and axial degrees of freedom includes a housing having a first end, a second end, and an integrally arranged hub and rim disposed between said first and second ends. The hub has a first central hole and the rim has a plurality of through-holes. An actuator assembly is disposed within the housing, and a bias spring is disposed between the housing and the actuator assembly for biasing the actuator assembly in a first direction.

24 Claims, 4 Drawing Sheets

METHOD AND APPARATUS FOR PUSH-BUTTON CONTROL

BACKGROUND OF THE INVENTION

This invention relates generally to push-button control knobs, and more particularly to a method and apparatus for providing rotational and axial control using a push-button control knob.

Control knobs are used on a variety of different devices, perform a variety of different functions and are typically used for controlling automotive systems, such as a radio, for example. Some control knobs have a rotational degree of freedom (rotary type), and have been used to control the volume of an audio system, and others have a translational degree of freedom (slide arrangement), and have been used to control the tone (bass and treble for example) of an audio system. Other control knobs have both rotational and axial (push-button type) degrees of freedom, and have been used to control both the volume and channel balance of a stereo audio system. Multi-functional control knobs provide a degree of convenience for the operator of the controlled device since the operator need only locate one control knob in order to perform more than one function. Push-button-rotary combination control knobs typically employ a control shaft that has both rotational and axial degrees of freedom, thereby requiring a special coupling between the control shaft and the controlled device.

BRIEF DESCRIPTION OF THE INVENTION

In one embodiment, a push-button control knob having rotational and axial degrees of freedom includes a housing having a first end, a second end, and an integrally arranged hub and rim disposed between the first and second ends. The hub has a central hole and the rim has a plurality of through-holes. An actuator assembly is disposed within the housing and a bias spring is disposed between the housing and the actuator assembly for biasing the actuator assembly in a first direction.

In another embodiment, a method for assembling a push-button control knob having rotational and axial degrees of freedom includes selecting a first actuator plate, grounding the first actuator plate in an orientation in preparation for assembly, selecting a housing in an orientation in preparation for assembly, aligning the axes of the housing and the first actuator plate, assembling the housing onto the first actuator plate, selecting a bias spring in an orientation in preparation for assembly, aligning the axes of the bias spring and the housing, assembling the bias spring onto the housing, selecting a second actuator plate in an orientation in preparation for assembly, aligning the axes of the second actuator plate and the first actuator plate, assembling the second actuator plate onto the first actuator plate, wherein the bias spring is captured between the housing and the second actuator plate, and wherein the first and second actuator plates are coupled together.

In a further embodiment, a push-button control knob having rotational and axial degrees of freedom includes a housing grounded to a shaft and having a rotational degree of freedom, an actuator assembly disposed within said housing and having an axial degree of freedom, and a bias spring disposed between said housing and said actuator assembly for biasing said actuator assembly in a first direction.

BRIEF DESCRIPTION OF THE DRAWINGS

Referring now to the figures, which are exemplary embodiments, and wherein like elements are numbered alike.

DETAILED DESCRIPTION OF THE INVENTION

A detailed description of an embodiment of the present invention is presented herein by way of exemplification and not limitation with reference to FIGS. 1–7.

Figure 4:
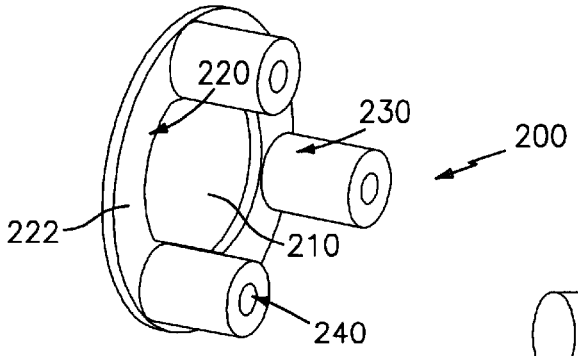
FIG. 4 depicts an isometric view of a first actuator plate in accordance with an embodiment of the invention.
Figure 5:
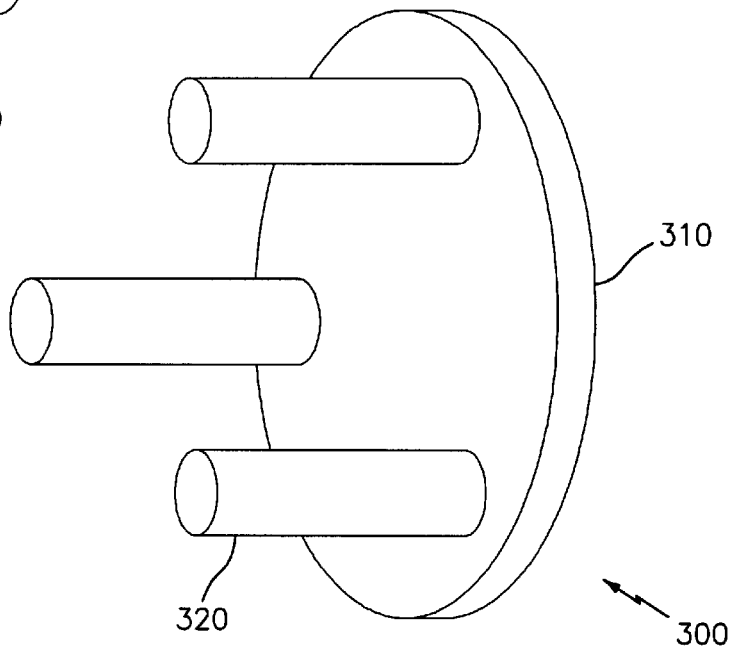
FIG. 5 depicts an isometric view of a second actuator plate in accordance with an embodiment of the invention.

Referring to FIGS. 1 and 3–5, a push-button control knob 10 includes a cylindrical housing 100, a first actuator plate 200, a second actuator plate 300, and a bias spring 400. In an embodiment, cylindrical housing 100 is cylindrically shaped, but cylindrical housing 100 may also be scalloped or ergonomically shaped. Cylindrical housing 100, as best seen by referring to FIG. 3, includes a first end 102, a second end 104, a centrally located cylindrical hub 110, an outer cylindrical surface that serves as a handle 120, and a rim 130 that extends between and is integral with hub 110 and handle 120. Hub 110 includes a central hole 140 that is preferably a blind-hole but may also be a through-hole. The shape of central hole 140 is a matter of design choice and may be circular or shaped, such as, for example, scalloped or "D" shaped. Rim 130 includes a plurality of through-holes 150, where in one embodiment three through-holes 150, spaced equidistant around rim 130, are shown by way of exemplification and not limitation. First actuator plate 200, as best seen by referring to FIG. 4, includes a central hole 210 that is surrounded by and defines a ring 220. Integral with ring 220 are a plurality of hollow pegs 230 having blind-holes 240. As seen in FIG. 4, an embodiment includes three hollow pegs 230 spaced equidistant around ring 220 and with axes parallel to the axis of central hole 210. Second actuator plate 300, as best seen by referring to FIG. 5, includes an actuator disc 310 and a plurality of pegs 320, three shown, integral with and disposed around the perimeter of actuator disc 310. As shown, the axes of pegs 320, spaced equidistant around the perimeter, are parallel to the axis of actuator disc 310. The preferred number of through-holes 150, hollow pegs 230, and pegs 320, is three. However, any number of through-holes 150, hollow pegs 230, and pegs 320 may be used where the push-button control knob 10 functions as described herein. In an alternative embodiment, hollow pegs 230 may be eliminated and pegs 320 may be coupled (e.g., adhered or bolted) directly to ring 220 of first actuator plate 200, thereby enabling push-button control knob 10 to function as described herein. In a further alternative embodiment, pegs 320 may be eliminated and hollow pegs 230 may be coupled directly to actuator disc 310. In yet a further alternative embodiment, there may be more or less than three through-holes 150, hollow pegs 230, and pegs 320, providing the push-button control knob 10 functions as described herein.

Figure 1:
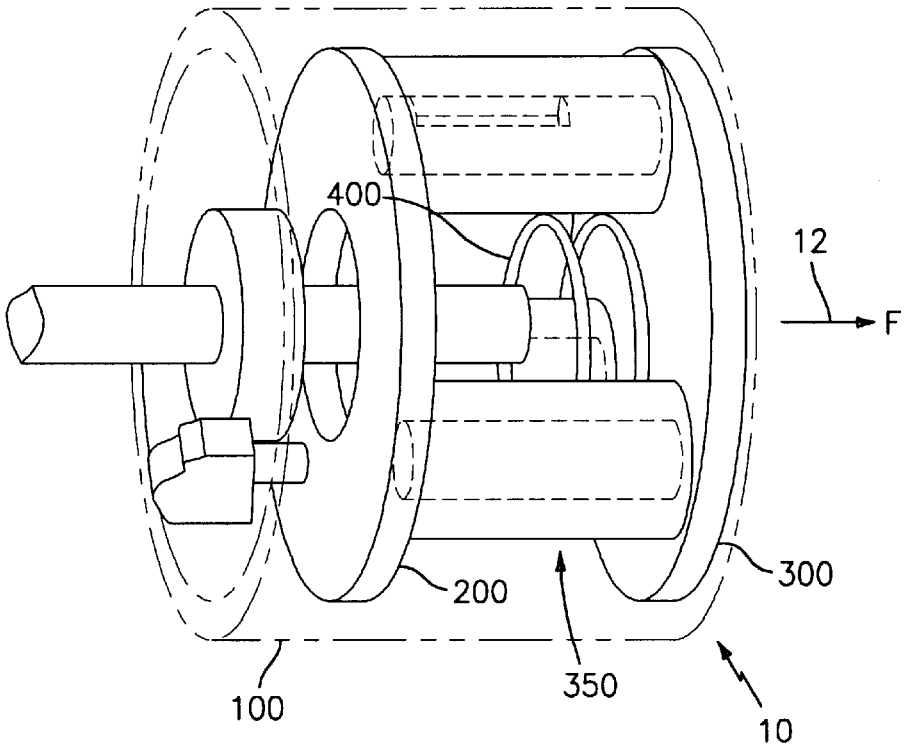
FIG. 1 depicts a cutaway isometric view of an assembled push-button control knob in accordance with an embodiment of the invention.
Figure 2:
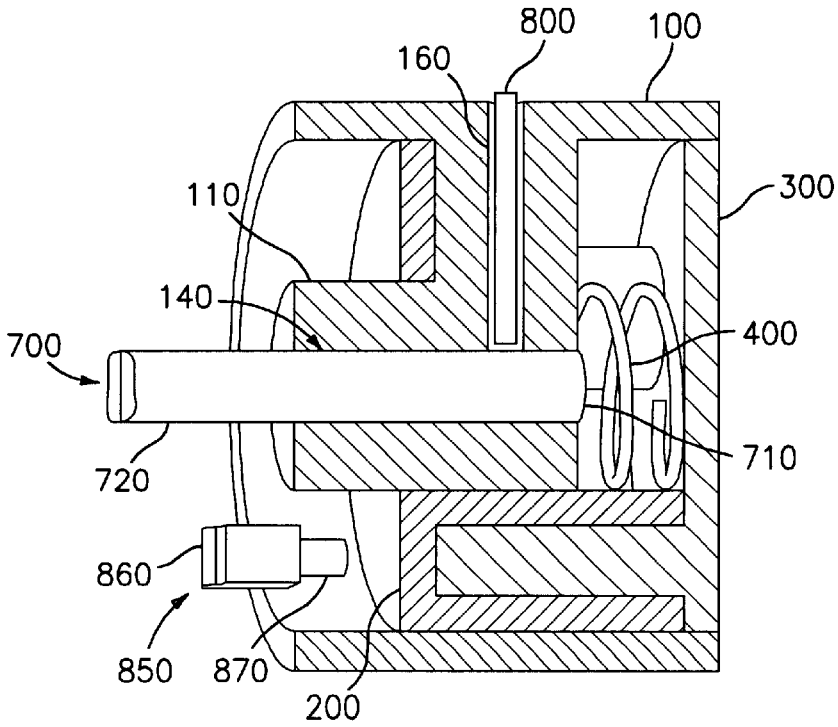
FIG. 2 depicts a cross-section side view of the assembled push-button control knob of FIG. 1.
Figure 3:
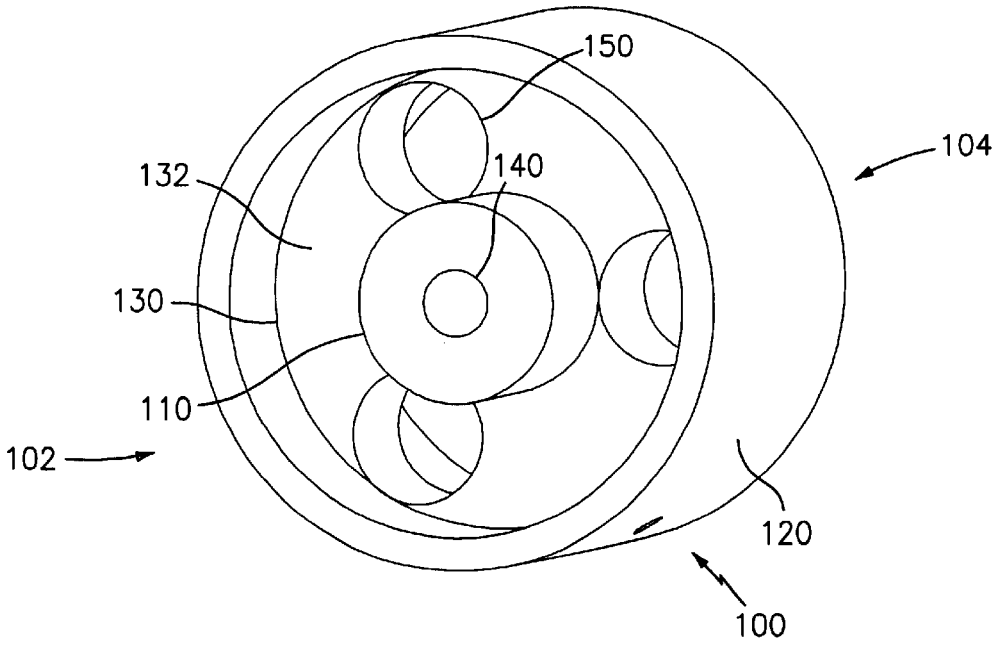
FIG. 3 depicts an isometric view of a cylindrical housing in accordance with an embodiment of the invention.
Figure 6:
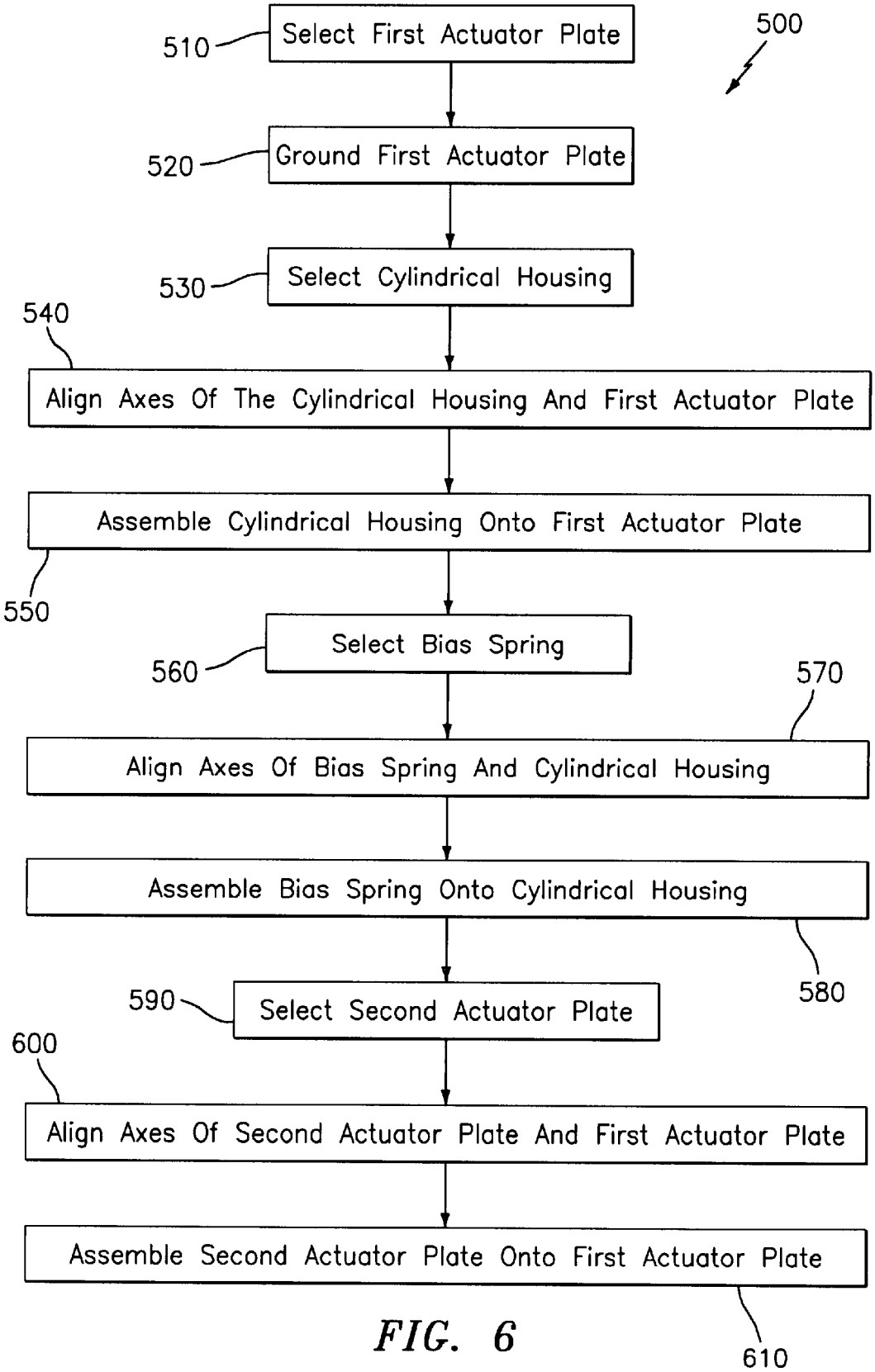
FIG. 6 depicts a process flowchart for assembling the push-button control knob of FIG. 1.

The assembly of push-button control knob 10 is best seen by now referring to the process 500 of FIG. 6 and the structures depicted by FIGS. 1 and 2. Referring to FIG. 6, process 500 begins by selecting 510 a first actuator plate 200 and then grounding 520 first actuator plate 200 on a working surface, such as a horizontal work bench (not shown), for example, in an orientation in preparation for assembly. An "orientation in preparation for assembly" refers to an orientation of a part that facilitates in-line or top-down assembly where the mating side of a first part faces the mating side of a second part. Regarding first actuator plate 200, an orientation in preparation for assembly refers to ring 220 being supported by work bench (not shown) with hollow pegs 230 facing up (upstanding).

At step 530, cylindrical housing 100 is selected and oriented in preparation for assembly. Here, cylindrical housing 100 is oriented with first end 102 facing down to face upstanding pegs 230. To assemble cylindrical housing 100 onto first actuator plate 200, not only must the axes of cylindrical housing 100 and first actuator plate 200 be aligned, but also the axes of through-holes 150 must be aligned with the axes of hollow pegs 230. At the proper orientation, cylindrical housing 100 assembles onto first actuator plate 200 with hollow pegs 230 protruding through through-holes 150. Central hole 210 of first actuator plate 200 is sufficiently sized to fit around hub 110, thereby permitting the top surface 222 of ring 220 to abut the bottom surface 132 of rim 130 when first actuator plate 200 is pushed against cylindrical housing 100.

At step 560, a suitable bias spring 400 is selected and oriented in preparation for assembly. In an embodiment, bias spring 400 is a helical compression spring, but may also be a leaf spring or a wave spring, and is oriented with its axis aligned 570 with the central axis of cylindrical housing 100. The outer diameter of bias spring 400 is appropriately sized to fit within the inner diameter defined by hollow pegs 230 of first actuator plate 200, such that bias spring 400 can be assembled 580 onto cylindrical housing 100 and nested within upstanding hollow pegs 230. Bias spring 400 may also be molded as an integral part of a molded second actuator plate 300.

At step 590, second actuator plate 300 is selected and then oriented such that pegs 320 face hollow pegs 230. At step 600, the axes of second actuator plate 300 and first actuator plate 200 are aligned. Also aligned are the axes of pegs 320 and hollow pegs 230. The assembly of push-button control knob 10 is completed by assembling 610 second actuator plate 300 onto first actuator plate 200, wherein pegs 320 are inserted into blind holes 240 of hollow pegs 230. A press fit arrangement between pegs 320 and hollow pegs 230 ensures a secure assembly. Alternatively, pegs 320 may be adhered to hollow pegs 230 using a suitable adhesive, or first and second actuator plates 200, 300 may be adhered or bolted to each other. The coupled (e.g., press-fit, adhered, or bolted) arrangement of first actuator plate 200 and second actuator plate 300 is herein referred to as an actuator assembly 350.

In the completed push-button control knob assembly 10, depicted in FIG. 1, the press fit assembly of first actuator plate 200 and second actuator plate 300 (the actuator assembly 350) is free to slide axially relative to cylindrical housing 100 by virtue of hollow pegs 230 sliding within through-holes 150 of rim 130. Bias spring 400, which is captured between cylindrical housing 100 and actuator disc 310 of second actuator plate 300, exerts a bias force "F" in the direction of arrow 12 (a first direction). The press-fit arrangement of the actuator assembly 350 is of sufficient strength to restrain bias spring 400 in its acquiescent state. When an operator pushes against actuator disc 310 to oppose bias force F (a second direction), bias spring 400 compresses to permit axial motion of actuator assembly 350, and therefore axial motion of ring 220, in the second direction. The rotational degree of freedom provided by cylindrical housing 100 and the axial degree of freedom provided by ring 220 can be used for multi-function control without requiring a special coupling between the control shaft and the controlled device, as will now be discussed in reference to FIG. 2.

In FIG. 2, assembled push-button control knob 10 is depicted in a cross-sectional side view having a section cut parallel to and coincident with the central axis of knob 10. A control shaft 700 is disposed within central hole 140 of hub 110 of cylindrical housing 100 during assembly of push-button control knob 10 to the controlled device (not shown). The assembly of knob 10 to shaft 700 is accomplished by aligning the axis of cylindrical housing 100 with the axis of control shaft 700 and assembling the central hole 140 of cylindrical housing 100 over the end 710 of control shaft 700 until cylindrical housing 100 is seated on control shaft 700. Control shaft 700 is seated when end 710 abuts the inside end wall of blind central hole 140. The end 710 of control shaft 700 is shaped to match the shape of central hole 140, which, as discussed above, may be circular or shaped, such as, for example, scalloped or "D" shaped, thereby providing a means for imparting a torque to control shaft 700 when push-button control knob 10 is rotated. The shaft body 720 is connected to the controlled device (not shown) and is herein referred to as being grounded.

The securement of push-button control knob 10 on control shaft 700 may be accomplished by a press-fit arrangement or the use of a set screw 800. If a set screw 800 is employed, the assembly of push-button control knob 10 requires the selection of a cylindrical housing having a trans-axial through-hole 160 that extends from an outer surface of cylindrical housing 100, the outer surface of handle 120, to the inner surface of central hole 140 of hub 110. During assembly, a set screw 800 is selected, in an orientation in preparation for assembly, and then assembled into the trans-axial through-hole 160 of cylindrical housing 100. Set screw 800 is then tightened to secure cylindrical housing 100 to control shaft 700.

The assembly of push-button control knob 10 to control shaft 700 places knob 10, and more particularly ring 220 of first actuator plate 200 of knob 10, in close proximity to switch 850, and more particularly to switch actuator 870. Switch body 860 is connected to the controlled device (not shown) and is herein referred to as being grounded.

The completed assembly of push-button control knob 10 to the controlled device (not shown) has both rotational and axial degrees of freedom, thereby providing multi-functional control of the controlled device. The rotation of cylindrical housing 100, via handle 120, imparts a torque to control shaft 700, and the depression of actuator disc 310, opposing force "F" of bias spring 400, imparts an axial force that is transmitted to switch actuator 870, via ring 220 of first actuator plate 200, for actuating switch 850. When switch 850 is in an acquiescent state, not actuated, the rotation of shaft 700 has a first function, such as, for example, adjustment of the volume level of an audio system. When switch 850 is actuated, the rotation of shaft 700 has a second function, such as, for example, adjustment of the channel balance of a stereo audio system. The apparatus can also be used to navigate through a menu, where the rotation action is used to move between different functions at the same level in the menu and the switch is used to select the respective function.

Figure 7:
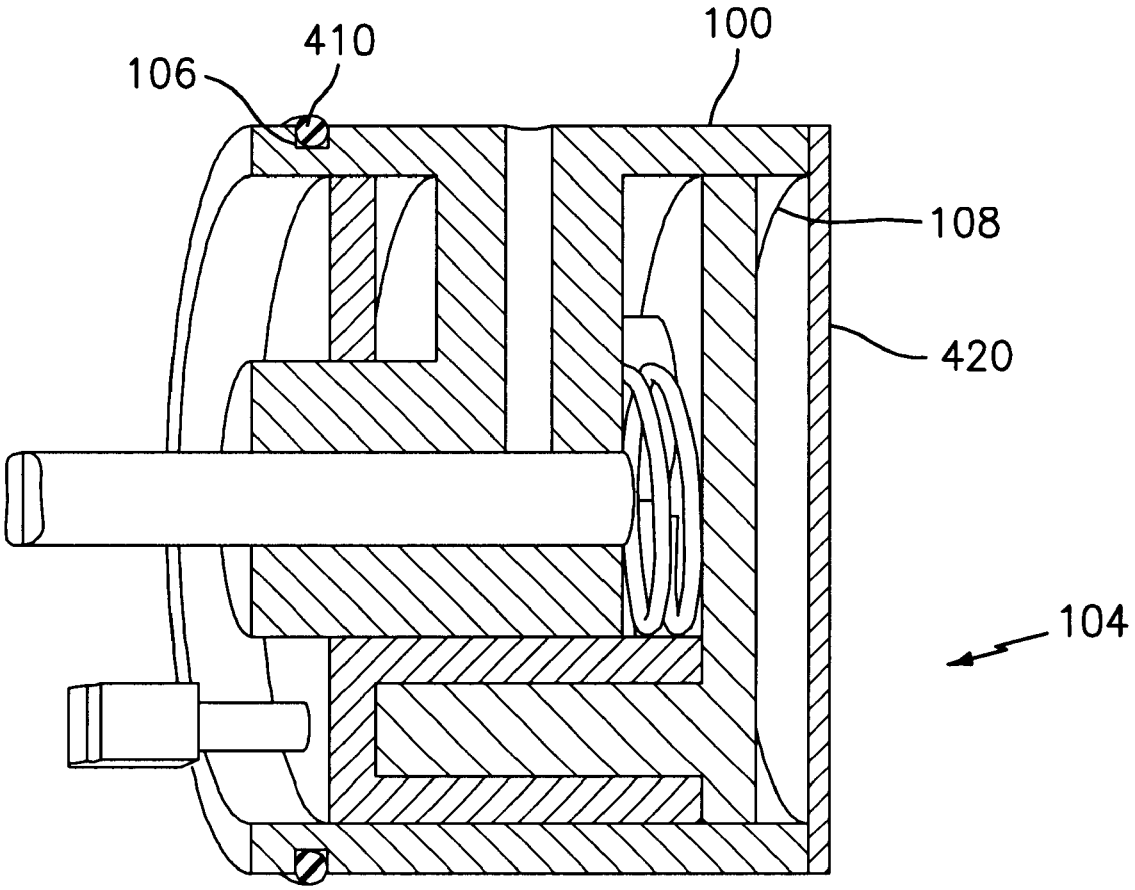
FIG. 7 depicts an alternative embodiment of the assembled push-button control knob of FIG. 1.

An alternative embodiment, depicted in FIG. 7, includes a groove 106 in cylindrical housing 100 for accepting an O-ring 410 that is elastically contained within groove 106. The O-ring 410 interacts with a mating surface of the controlled device (not shown) to provide for a waterproof arrangement when assembled. In addition to O-ring 410, a flexible membrane 420 may be employed over the second end 104 of cylindrical housing 100 by stretching the flexible membrane 420 and attaching it to the outer edge 108 of cylindrical housing 100. If cylindrical housing 100 and flexible membrane 420 are made of polymeric material, they may be attached using a heat staking process. The adhesion of flexible membrane 420 to outer edge 108 of cylindrical housing 100 provides for additional waterproof protection. Use of an elastomeric material for flexible membrane 420 will also provide a spring-like action, which could be used to bias second actuator plate 300 in the first direction by attaching flexible membrane 420 to second actuator plate 300, thereby negating the need for bias spring 400. O-ring 410 and flexible membrane 420 may be used singly or jointly, and provide not only waterproof protection, but also protection from contaminates and impurities.

As shown and discussed, and in accordance with an embodiment of the invention, multi-functional control of a controlled device is achieved without the need for a control shaft to have both rotational and axial degrees of freedom, thereby avoiding the need for a special coupling between control shaft 700 and the controlled device (not shown). Additionally, the axial motion of a centrally located actuator disc 310 does not require the cylindrical housing 100 to have space between itself and the front panel of the controlled device (not shown), thereby resulting in a lower profile push-button control knob 10. Further, the use of a ring 220 on first actuator plate 200 provides for switch actuator 870 to be located off-axis for ease of assembly.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A push-button control knob having rotational and axial degrees of freedom, comprising:

a housing having a first end, a second end, and a hub and rim disposed between said first and second ends, said hub comprising a first central hole, and said rim comprising a plurality of through-holes;

an actuator assembly disposed within said housing; and a bias spring disposed between said housing and said actuator assembly for biasing said actuator assembly in a first direction.

2. The push-button control knob of claim 1, wherein said actuator assembly comprises:

a first actuator plate disposed at said first end of said housing; and a second actuator plate disposed at said second end of said housing and coupled to said first actuator plate.

3. The push-button control knob of claim 2, wherein said bias spring comprises:

a bias spring disposed at said second end of said housing between said rim and said second actuator plate.

4. The push-button control knob of claim 3, wherein said bias spring comprises:

a bias spring selected from the group consisting of: a compression spring, a leaf spring, and a wave spring.

5. The push-button control knob of claim 2, wherein said first actuator plate further comprises:

a second central hole defining a ring thereabout and a plurality of hollow pegs integral to said ring; and wherein said plurality of hollow pegs are disposed within said plurality of through-holes of said rim.

6. The push-button control knob of claim 5, wherein said second actuator plate further comprises:

an actuator disc; and a plurality of pegs integral with said actuator disc and disposed within said plurality of hollow pegs of said first actuator plate.

7. The push-button control knob of claim 6, wherein:

said plurality of through-holes of said rim are disposed equidistant around said rim and have axes parallel to the axis of said housing;

said plurality of hollow pegs of said first actuator plate are disposed equidistant around said ring and have axes parallel to the axis of said second central hole; and said plurality of pegs of said second actuator plate are disposed equidistant around the perimeter of said second actuator plate and have axes parallel to the axis of said actuator disc.

8. The push-button control knob of claim 7, wherein:

said plurality of through-holes of said rim comprises three through-holes;

said plurality of hollow pegs of said first actuator plate comprises three hollow pegs; and said plurality of pegs of said second actuator plate comprises three pegs.

9. The push-button control knob of claim 6, wherein:

said plurality of pegs of said second actuator plate are press fit within said plurality of hollow pegs of said first actuator plate.

10. The push-button control knob of claim 2, wherein said first and second actuator plates are coupled together using at least one of a press-fit, an adhesive, or a bolted arrangement.

11. The push-button control knob of claim 1, wherein:

said hub, rim and housing are integrally arranged.

12. The push-button control knob of claim 1, wherein:

said housing further comprises a trans-axial through-hole extending from an outer surface of said housing to an inner surface of said first central hole of said hub for accepting a set screw.

13. The push-button control knob of claim 12, further comprising a control shaft and a set screw, wherein:

said first central hole of said hub is coupled to said control shaft by said set screw disposed within said trans-axial through-hole.

14. The push-button control knob of claim 13, further comprising a grounded switch, wherein:

said ring of said first actuator plate is disposed proximate said switch, wherein said switch is in an acquiescent state when said actuator assembly is biased in said first direction and wherein said switch is in an actuated state when said actuator assembly is biased in a second direction.

15. The push-button control knob of claim 1, wherein;

said bias spring comprises a flexible membrane.

16. The push-button control knob of claim 1, further comprising at least one of:

an O-ring elastically retained by a groove disposed in the outer surface of said housing at said first end of said housing, or a flexible membrane disposed at the outer edge of said housing at said second end of said housing.

17. A method for assembling a push-button control knob having rotational and axial degrees of freedom, comprising:

selecting a first actuator plate;

grounding the first actuator plate in an orientation in preparation for assembly;

selecting a housing having a first central hole in an orientation in preparation for assembly;

aligning the axes of the housing and the first actuator plate;

assembling the housing onto the first actuator plate;

selecting a bias spring in an orientation in preparation for assembly;

aligning the axes of the bias spring and the housing;

assembling the bias spring onto the housing;

selecting a second actuator plate in an orientation in preparation for assembly;

aligning the axes of the second actuator plate and the first actuator plate;

assembling the second actuator plate onto the first actuator plate, wherein the bias spring is captured between the housing and the second actuator plate, and wherein the first and second actuator plates are coupled together.

18. The method for assembling set forth in claim 17, wherein:

said selecting a first actuator plate comprises selecting a first actuator plate having a second central hole defining a ring thereabout and a plurality of hollow pegs integral to said ring, wherein the axes of said plurality of hollow pegs are parallel to the axis of said second central hole; wherein said selecting a housing comprises selecting a housing having a first end, a second end, and an integrally arranged hub and rim disposed between said first and second ends, wherein said hub comprises a first central hole and wherein said rim comprises a plurality of through-holes having axes parallel to the axis of said first central hole; wherein said selecting a bias spring comprises selecting a bias spring selected from the group consisting of: a compression spring, a leaf spring, and a wave spring; and wherein said selecting a second actuator plate comprises selecting a second actuator plate having an actuator disc and a plurality of pegs integral to and disposed at the perimeter of said actuator disc, wherein said plurality of pegs have axes parallel to the axis of said actuator disc.

19. The method for assembling set forth in claim 18, wherein:

said assembling the housing comprises assembling the first end of the housing onto the first actuator plate wherein each of the plurality of through-holes in the rim of the housing encircle each of the plurality of hollow pegs of the first actuator plate; and wherein said assembling the second actuator plate comprises assembling each of the plurality of pegs of the second actuator plate within each of the plurality of hollow pegs of the first actuator plate.

20. The method for assembling set forth in claim 19, wherein:

said assembling the second actuator plate further comprises assembling each of the plurality of pegs of the second actuator plate in a press fit relation with each of the plurality of hollow pegs of the first actuator plate.

21. The method for assembling set forth in claim 18, further comprising:

selecting a housing having a trans-axial through-hole extending from an outer surface of said housing to an inner surface of said first central hole of said hub for accepting a set screw;

aligning the axis of the housing with the axis of a control shaft;

assembling the first central hole of the housing over the end of the control shaft until the housing is seated on the control shaft;

selecting a set screw in an orientation in preparation for assembly;

assembling the set screw into the trans-axial through-hole of the housing; and securing the housing to the control shaft by tightening the set screw.

22. A push-button control knob having rotational and axial degrees of freedom, comprising:

a housing grounded to a shaft and having a rotational degree of freedom;

an actuator assembly disposed within said housing and having an axial degree of freedom; and a bias spring disposed between said housing and said actuator assembly for biasing said actuator assembly in a first direction.

23. The push-button control knob of claim 22, further comprising:

a switch having a switch body and a switch actuator wherein said switch body is grounded and said switch actuator is displaced from the axis of the shaft; and wherein said actuator assembly actuates said switch actuator when said actuator assembly is depressed in a second direction that opposes the force of said bias spring.

24. The push-button control knob of claim 23, further comprising:

a set screw disposed within said housing for securing said housing to the shaft.

* * * * *